US008244159B2

(12) United States Patent
Woo

(10) Patent No.: US 8,244,159 B2
(45) Date of Patent: Aug. 14, 2012

(54) IMAGE FORMING APPARATUS AND DEVELOPING CARTRIDGE THEREOF

(75) Inventor: Ji-Hoon Woo, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 129 days.

(21) Appl. No.: 12/760,340

(22) Filed: Apr. 14, 2010

(65) Prior Publication Data

US 2010/0303503 A1 Dec. 2, 2010

(30) Foreign Application Priority Data

May 29, 2009 (KR) ..... 10-2009-0047849

(51) Int. Cl.
*G03G 15/00* (2006.01)

(52) U.S. Cl. ..... 399/167; 399/88

(58) Field of Classification Search ..... 399/167, 399/159, 111, 88
See application file for complete search history.

(56) References Cited

U.S. PATENT DOCUMENTS

| | | | | |
|---|---|---|---|---|
| 7,603,059 | B2 * | 10/2009 | Marumoto | 399/167 |
| 2006/0018681 | A1 * | 1/2006 | Kim et al. | 399/167 |
| 2007/0189805 | A1 * | 8/2007 | Takigawa | 399/111 |
| 2009/0317129 | A1 * | 12/2009 | Abe et al. | 399/111 |

* cited by examiner

*Primary Examiner* — Sophia S Chen
(74) *Attorney, Agent, or Firm* — Stanzione & Kim, LLP

(57) ABSTRACT

Disclosed are an image forming apparatus of improved power transmission structure and a developing cartridge thereof. The image forming apparatus may include a main body; a driving unit which includes a driving shaft mounted to the main body and a driving coupler connected to the driving shaft. The driving coupler may be provided with a plurality of driving tips. The image forming apparatus may further include a consumable unit that may be detachably received in the main body. The consumable unit may include a driven shaft, a rotating body rotating with the driven shaft and a passive coupler rotating with the driven shaft. The passive coupler may be provided with a plurality of passive tips. The plurality of driving tips and the plurality of passive tips may come into engaging contact with each other when the consumable unit is operably received in the main body, and may remain in the engaging contact even when the respective rotational axes of the driving shaft and the driven shaft intersect with each other.

14 Claims, 16 Drawing Sheets

IMAGE FORMING APPARATUS AND DEVELOPING CARTRIDGE THEREOF

CROSS-REFERENCE TO RELATED APPLICATION

This application claims priority from Korean Patent Application No. 10-2009-0047849, filed on May 29, 2009 in the Korean Intellectual Property Office, the disclosure of which is incorporated herein by reference.

TECHNICAL FIELD

The present disclosure relates generally to an image forming apparatus and a developing cartridge thereof, and, more particularly, to an image forming apparatus having an improved power transmission structure and a developing cartridge thereof.

BACKGROUND OF RELATED ART

An image forming apparatus, which forms an image on a print medium, may be classified broadly into an electrophotographic type, in which a series of charging—light exposure—developing with developer—transferring—fusing—cleaning processes are performed to form an image on a print medium; an inkjet type where small ink droplets are selectively ejected from nozzles onto a print medium to form an image; and a thermal transfer type where a thermal print head is used.

In the case of the electrophotographic type image forming apparatus, toners of yellow (Y), magenta (M), cyan (C), and black (K) are applied to the print medium in a manner overlapping with one another to form a desired color image. Such a color electrophotographic type image forming apparatus may include a plurality of developing cartridges corresponding to the respective colors.

Each developing cartridge may include a photosensitive body on which an electrostatic latent image is formed, a developing roller which develops the electrostatic latent image with toner of the color corresponding to the particular developing cartridge, and a supplying roller which supplies the toner to the developing roller.

On the surfaces of the photosensitive bodies, visible images are developed with the toners of the respective colors by the developing rollers. In order to obtain a color image of good quality, the visible images have to be precisely applied at the correct positions so that when the visible images are overlapped with one another, the resulting color image shows a good alignment between the individual visible images or a good color registration as it is sometimes referred to.

The quality of the color image is affected by an error in color registration. That is, the less the error in the color registration, the higher the quality of the color image can be. One measure of the error in the color registration may be considered as the maximum spatial deviation of the individual dots of all four colors (Y, M, C, K) typically used to form a full color image.

Many image forming apparatus include components or subunits that can be detached from and reinstalled in the main body of the image forming apparatus so that these detachable units can be repaired, replenished and/or replaced. One such detachable unit that may also be a possible source of, or that may play some role in, color registration error may be the detachable developing cartridge that houses therein the photosensitive body or bodies. When a detachable developing cartridge is mounted in the main body of the image forming apparatus, a passive coupler at the end of a rotating shaft of the photosensitive body and a driving coupler at the end of a driving shaft provided in the main body become engaged with each other so that the rotational driving force can be transmitted to the photosensitive body. The passive coupler and the driving coupler engage in a face-to-face contact with each other to transmit the driving force.

Typically, the passive coupler has a plurality of first contact planes while the second coupler has a plurality of second contact planes. Corresponding ones of these contact planes come into the face-to-face contact with each other with the surface contact force acting along the direction parallel to the rotating shaft of the photosensitive body.

As the coupling of the passive coupler and the driving coupler is based primarily on surface contact where the surface contact pressure acts along the rotational axial direction, the driving shaft and the rotating shaft of the photosensitive body may be driven in the state in which they are misaligned with each other due to the fabrication and assembly tolerance, the vibration during operation, or the like. As a consequence, a change in the contact position or even no contact may occur between the first contact planes and the second contact planes respectively of the passive coupler and the driving coupler. Such misalignment in or lack of contact between the contact planes may cause the photosensitive body to rotate at a rotational speed that is not constant, but which varies in a periodic pattern, for example, as illustrated in FIGS. 1 and 2.

FIG. 1 plots the results of an experiment, in which, using a conventional image forming apparatus, and for each of the colors Y, M, C and K, a line of one hundred test points or dots is printed along a lengthwise direction of a print medium, and, for each of such test points, the positional error, i.e., the deviation distance, is measured. In FIG. 1, the X-axis represents the lengthwise direction of the print medium (i.e., the vertical scanning direction or the direction of travel of the print medium) while the Y-axis represents the positional error of the dots. Further, in FIG. 1, X=0 and X=250 indicate the leading and trailing edges of the print medium, respectively.

Plotted in FIG. 2 are the maximum spatial error (i.e., color registration error) among the four color lines at each test point from the results of FIG. 1. As can be observed from the plots, the color registration error varies, fluctuating periodically for several periods even during printing of a single page. The test results also show that the maximum color registration error observed was about 210 μm, and that color registration errors of no less than 126 μm (i.e., the approximate combined width of three dots for a resolution of 600 dpi) occurred at 41.4% of the test points. Accordingly, an improvement of the color registration is desired.

SUMMARY OF DISCLOSURE

According to an aspect of the present disclosure, there may be provided an image forming apparatus that may include a main body, a driving unit and a consumable unit. The driving unit may be mounted to the main body, and may comprise a driving shaft and a driving coupler connected to the driving shaft. The driving coupler may have arranged thereon a plurality of driving tips. The consumable unit may be detachably received in the main body, and may comprise a rotating body configured to rotate with a driven shaft and a passive coupler connected to the driven shaft. The passive coupler may have arranged thereon a plurality of passive tips. The corresponding ones of the plurality of driving tips and the plurality of passive tips may come into engaging contact with each other when the consumable unit is operably received in the main body. The corresponding ones of the plurality of driving tips and the plurality of passive tips may maintain the engaging contact with each other when respective rotational axes of the driving shaft and the driven shaft intersect each other.

At least one of the driving coupler and the passive coupler may comprise a primary coupler and a secondary coupler. The primary coupler may be coupled to, and may be rotatable with, the at least one of the driving shaft and the driven shaft. The secondary coupler may be moveable along a direction of a rotational axis of the at least one of the driving shaft and the driven shaft toward and away from the primary coupler, and may be in one or more point-contacts with the primary coupler with respect to a rotational direction of the at least one of the driving shaft and the driven shaft.

The primary coupler may comprise a plurality of circumferential projections protruding outwardly from an outer surface thereof. The secondary coupler may have an inner surface defining a space into which the primary coupler is received. A plurality of accommodating grooves being arranged on the inner surface. The plurality of circumferential projections of the primary coupler may each be receivable into, so as to be in a point-contact with, a respective corresponding one of the plurality of accommodating grooves.

According to another aspect of the present disclosure, an image forming apparatus may be provided to include a main body, a driving unit and a consumable unit. The driving unit may be mounted to the main body, and may comprise a driving shaft and a driving coupler connected to the driving shaft. The driving coupler may have arranged thereon a plurality of driving tips. The consumable unit may be detachably received in the main body, and may comprise a rotating body configured to rotate with a driven shaft and a passive coupler connected to the driven shaft. The passive coupler may have arranged thereon a plurality of passive tips. The corresponding ones of the plurality of driving tips and the plurality of passive tips may be in a point-contact with each other with respect to a rotational direction of at least one of the driving shaft and the drive shaft.

According to yet another aspect of the present disclosure, there may be provided a developing cartridge that may be detachably receivable in a main body of an image forming apparatus which includes a driving shaft that rotationally drives a driving coupler having arranged thereon a plurality of driving tips. The developing cartridge may include a frame, an image carrying body, a developing roller and a passive coupler. The frame may define a volume into which developer is received. The image carrying body may be rotatably arranged in the frame. The developing roller may be rotatably arranged adjacent the image carrying body, and may be configured to convey the developer received in the volume to the image carrying body. The passive coupler may be connected to at least one of respective rotating shafts of the image carrying body and the developing roller, and may have arranged thereon a plurality of passive tips. The plurality of passive tips may be arranged such that each of the plurality of passive tips comes into an engaging contact with a respective corresponding one of the plurality of driving tips of the driving coupler of the image forming apparatus when the developing cartridge is operably received in the main body of the image forming apparatus. The corresponding ones of the plurality of driving tips and the plurality of passive tips may maintain the engaging contact with each other when respective rotational axes of the driving shaft and the driven shaft intersect each other.

According to even yet another aspect of the present disclosure, a developing cartridge may be detachably receivable in a main body of an image forming apparatus which includes a driving shaft that rotationally drives a driving coupler having arranged thereon a plurality of driving tips. The developing cartridge may comprise a frame, an image carrying body, a developing roller and a passive coupler. The frame may define a volume into which developer is received. The image carrying body may be rotatably arranged in the frame. The developing roller may be rotatably arranged adjacent the image carrying body, and may be configured to convey the developer received in the volume to the image carrying body. The passive coupler may be connected to at least one of respective rotating shafts of the image carrying body and the developing roller, and may have arranged thereon a plurality of passive tips. The corresponding ones of the plurality of driving tips and the plurality of passive tips may be in a point-contact with each other with respect to a rotational direction of at least one of the driving shaft and the drive shaft.

According to even still yet another aspect of the present disclosure, an apparatus for transferring a rotational force between a first and second rotational shafts may be provided to comprise a first coupler and a second coupler. The first coupler may be supported on the first rotational shaft in such a manner the first coupler rotates with the first rotational shaft, and may have arranged thereon a plurality of contact surfaces. The second coupler may be supported on the second rotational shaft in such a manner the second coupler rotates with the second rotational shaft, and may have arranged thereon a plurality of circumferentially spaced protrusions each having at least a first portion thereof extending along a first direction parallel to a rotational axis of the second rotational shaft and at least a second portion thereof extending along a second direction non-parallel to the first direction so as to define a tip that is oriented circumferentially in a direction of rotation of the second rotational shaft. The second coupler may be configured to be operably coupled to the first coupler such that the tip associated with each circumferentially spaced protrusion of the second coupler comes into a pressing contact with a respective corresponding one of the plurality of contact surfaces of the first coupler so that the rotational force is transferred from one of the first and second rotational shaft to the other through the pressing contact between the tips of the plurality of circumferentially spaced protrusions and the plurality of contact surfaces of the first coupler.

The second coupler may comprise a primary driving coupler and a secondary driving coupler. The primary driving coupler may be coupled to the second rotational shaft such that the primary driving coupler rotates with the second rotational shaft, and may have an outer surface on which one or more projections that protrude outwardly from the outer surface are arranged. The secondary driving coupler may have the plurality of circumferentially spaced protrusions arranged on a first end thereof and a cavity formed on a second end opposite the first end thereof. The cavity may have arranged on an inner surface thereof one or more grooves. The primary driving coupler being receivable into the cavity of the secondary driving coupler in such a manner that each of the one or more projections of the primary driving coupler is received into a respective corresponding one of the one or more grooves, and such that the outer surface of the primary driving coupler is spaced apart from the inner surface of the cavity by a first gap.

Each of the one or more projections may make a point contact with a surface of the respective corresponding one of the one or more grooves into which it is received.

Each of the one or more projections may be movable about the point contact within the respective corresponding one of the one or more grooves into which it is received such that the primary driving coupler has a three dimensional degree of freedom of movement with respect to the secondary driving coupler.

Each of the plurality of circumferentially spaced protrusions may comprise a first inclined surface that extends away from the tip thereof and that forms an acute angle with a first line extending from the tip parallel to a rotational axis of the second coupler.

Each of the plurality of circumferentially spaced protrusions may comprise a second inclined surface that extends away from the tip and that forms an acute angle with a second line extending from the tip to a radial center of the second coupler.

BRIEF DESCRIPTION OF THE DRAWINGS

Various features and advantages of the present disclosure will become apparent and more readily appreciated from the following description of several embodiments thereof, taken in conjunction with the accompanying drawings, of which.

DETAILED DESCRIPTION OF SEVERAL EMBODIMENTS

Figure 1:
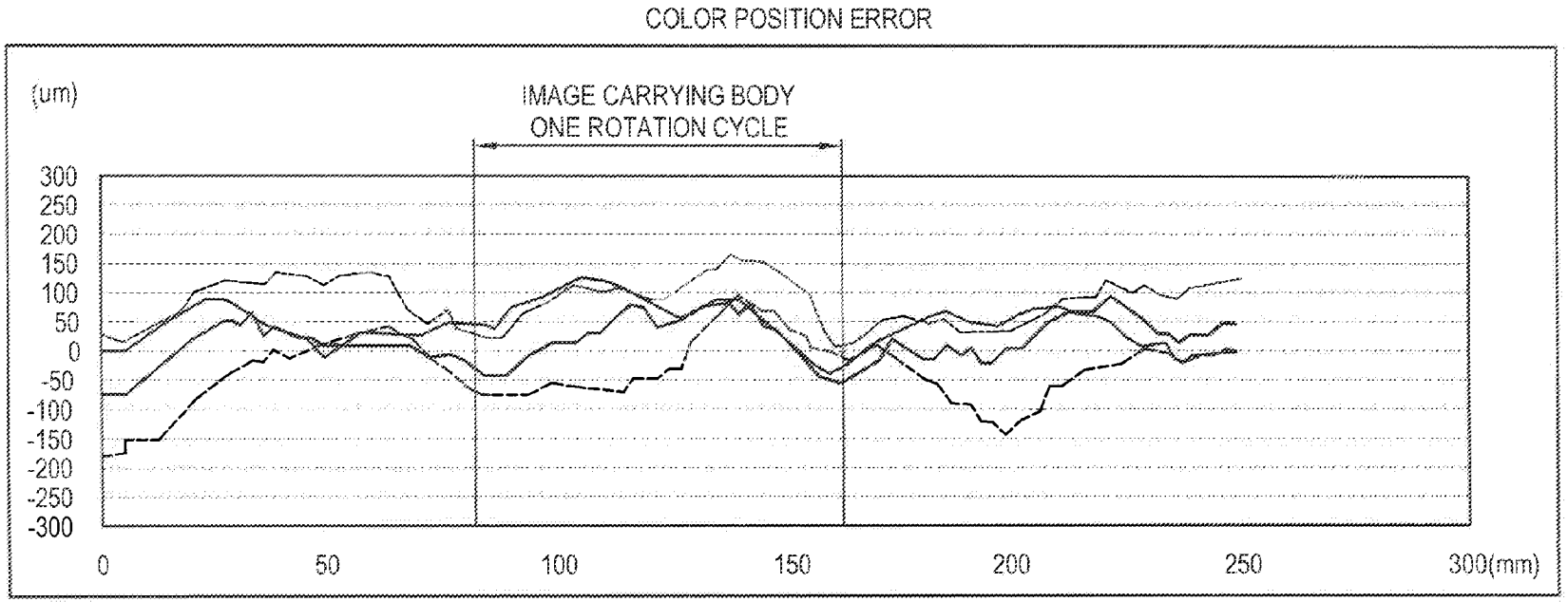
FIG. 1 (RELATED ART)
FIGS. 1 and 2 are graphs illustrative of the color positional errors of a conventional image forming apparatus.

Reference will now be made in detail to several embodiments, examples of which are illustrated in the accompanying drawings, wherein like reference numerals refer to like elements throughout, repetitive descriptions of which may be omitted. It should be also noted that in the drawings, the dimensions of the features are not intended to be to true scale and may be exaggerated for the sake of allowing greater understanding.

Figure 3:
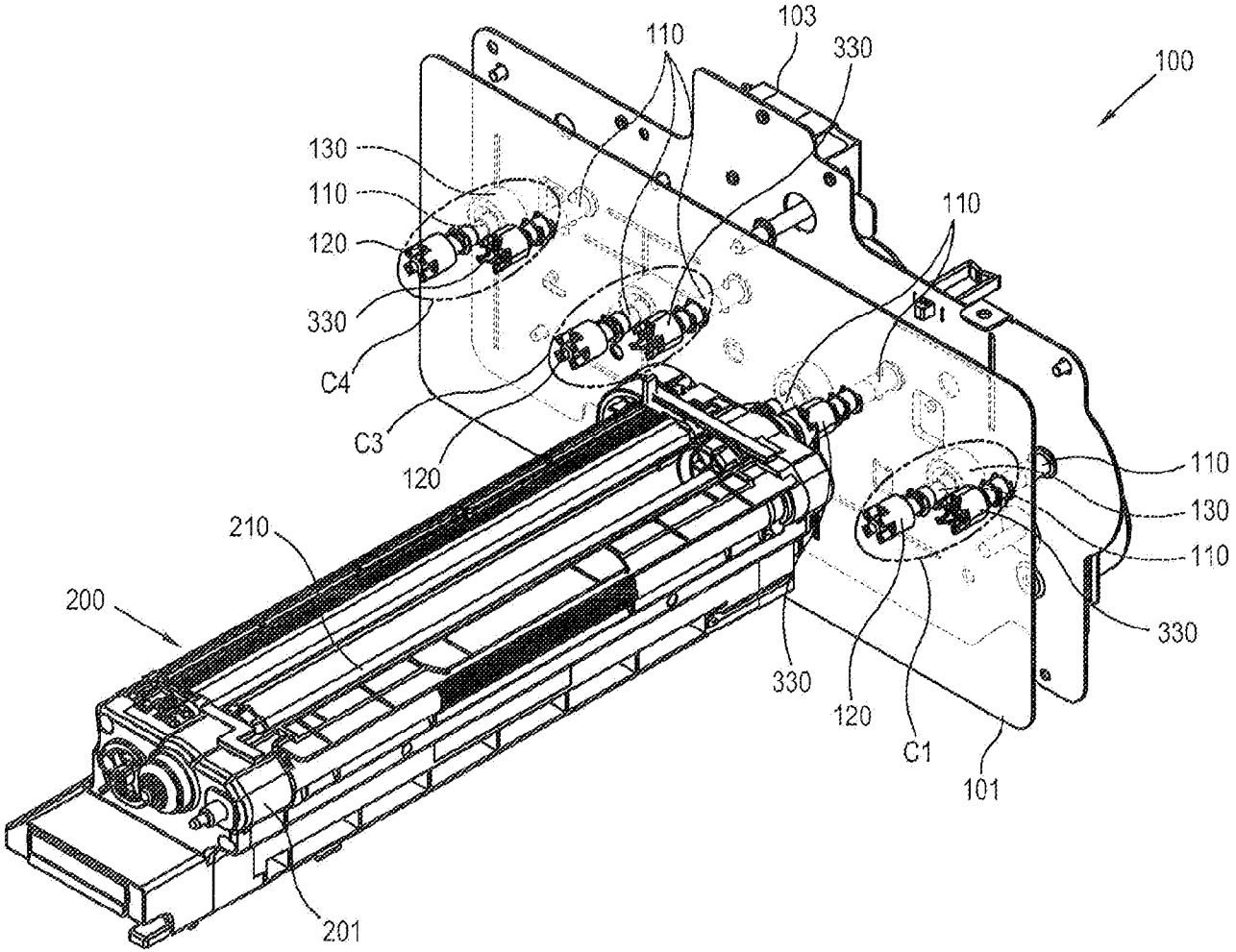
FIG. 3 is a perspective view of relevant portions of an image forming apparatus according to an embodiment of the present disclosure.
Figure 4:
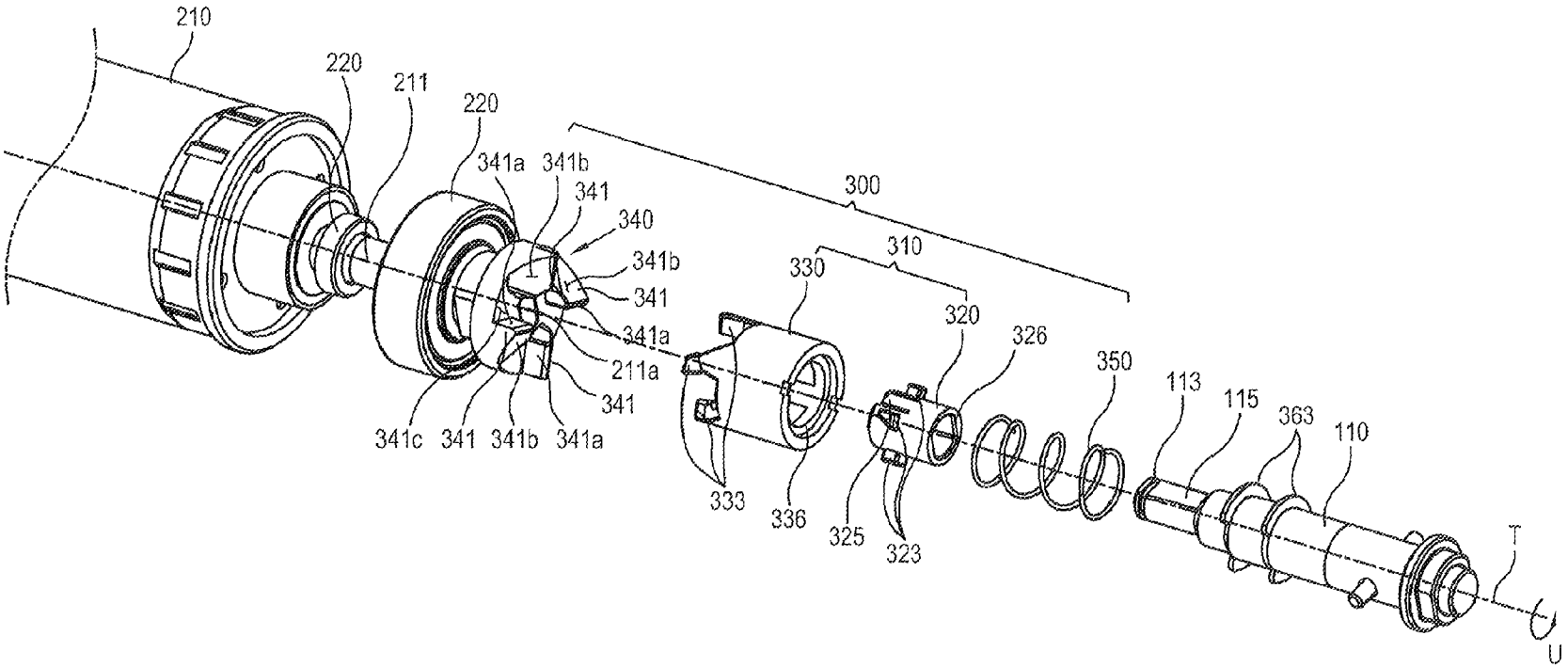
FIG. 4 is an exploded perspective view schematically showing an image carrying body, a driving shaft and a power transmission unit according to an embodiment of the present disclosure.

As shown in FIGS. 3 and 4, an image forming apparatus 100 according to an embodiment of the present disclosure may include frames 101 and 103 secured to the main body of the image forming apparatus 100; developing cartridges 200 and a power transmission unit 300 for transmitting the driving force from a driving shaft 110 supported by the frames 101 and 103 to the developing cartridge 200.

The developing cartridge 200 may include an image carrying body 210; a developing roller 240 (shown in FIG. 15) for supplying developer to the image carrying body 210 to thereby develop a latent image on the image carrying body 210; a feeding roller 230 (shown in FIG. 15) for supplying the developer to the developing roller 240; a storage unit (not shown) for storing therein the developer and an agitator (not shown) to stir the developer stored in the storage unit.

The developing cartridge 200 may be detachably mounted to the main body of the image forming apparatus 100, and may thus be removed from the image forming apparatus 100 for service. The developing cartridge 200 may itself or some of its constituent components of the developing cartridge 200 may be considered consumable or replaceable. That is, some of the components or devices accommodated in the developing cartridge 200, such as, for example, the developer, the image carrying body 210, the developing roller 240, the feeding roller 230 and the agitator, may be consumable or replaceable, that is, these can be replenished when used up, repaired or replaced when broken or at the end of useful life.

A rotating shaft 211 (hereinafter, referred to as an "image carrying body shaft") of the image carrying body 210 may be rotatably supported on a cartridge main body 201 of the developing cartridge 200 through a bearing or bearings 220.

According to an embodiment, the image forming apparatus 100 may includes four developing cartridges 200 each respectively corresponding to the yellow (Y), magenta (M), cyan (C) and black (K) colors, and thus may be capable of forming a color image. The developing cartridges 200 may each have the same configuration as the foregoing developing cartridge 200, but may be different in the color of the developer stored therein. The image carrying body 210 may be a photosensitive body that has an outer surface coated with an organic photosensitive material, on which surface a latent image may be created by exposing the surface is exposed with light using an exposure unit 20 (shown in FIG. 15) to create a pattern of electrical potential differences between the exposed and non-exposed portions of the surface. The developing roller 240 (shown in FIG. 15) may apply the developer of the color associated with the particular developing cartridge on the surface of the image carrying body 210 so as to develop the latent image into a visible developer image of the associated color.

When the developing cartridge 200 is mounted to the main body, a driving coupler 310 and a passive coupler 340 of the power transmission unit 300 (which will be described later in greater detail) may become engaged with each other so that power of the driving coupler 310 can be transmitted to the developing cartridge 200 via the passive coupler 340. When the developing cartridge 200 is detached from the main body of the image forming apparatus, the passive coupler 340 is released from the driving coupler 310.

For purposes of illustrative convenience, only one developing cartridge 200 is illustrated in FIG. 3 while only the driving couplers C1, C3 and C4 are illustrated in places of the other developing cartridges 200 that are not illustrated. It should be understood that the following descriptions in reference to one developing cartridge will be applicable to the other developing cartridges as well.

As shown in FIG. 3, each developing cartridge 200 may receives the motional power through the two driving shafts 110, one of which may directly drive the image carrying body shaft 211 while the other may drive other rotating bodies, e.g., the developing roller 240 (see FIG. 15), the feeding roller 230 (see FIG. 15), the agitator (not shown), etc. Alternatively, each developing cartridge 200 may receive the rotational power from a single driving shaft 110.

The driving shaft 110 may receive the motional power from a driving motor (not shown) through a gear 130. According to an embodiment, to reduce the production cost, fewer than four driving motors or even a single motor may be used to drive the four developing cartridges 200.

According to an embodiment, a driving couplers 310 may includes a surface-contact driving coupler 120 configured for a face-to-face contract engagement with the passive coupler 340 and a point-contact driving coupler 330 for a point-to-point contact engagement with the passive coupler 340.

For example, the point-contact driving coupler 330 may used for driving a rotational body that requires a relatively high uniformity in the rotational speed, e.g., the image carrying body 210 while using the surface-contact driving coupler 120 for driving other rotating bodies (e.g., the developing roller, the feeding roller, and the agitator) that requires relatively low uniformity of speed. Alternatively, the point-contact driving coupler 330 may be used for driving two or more or all rotating bodies.

Figure 5:
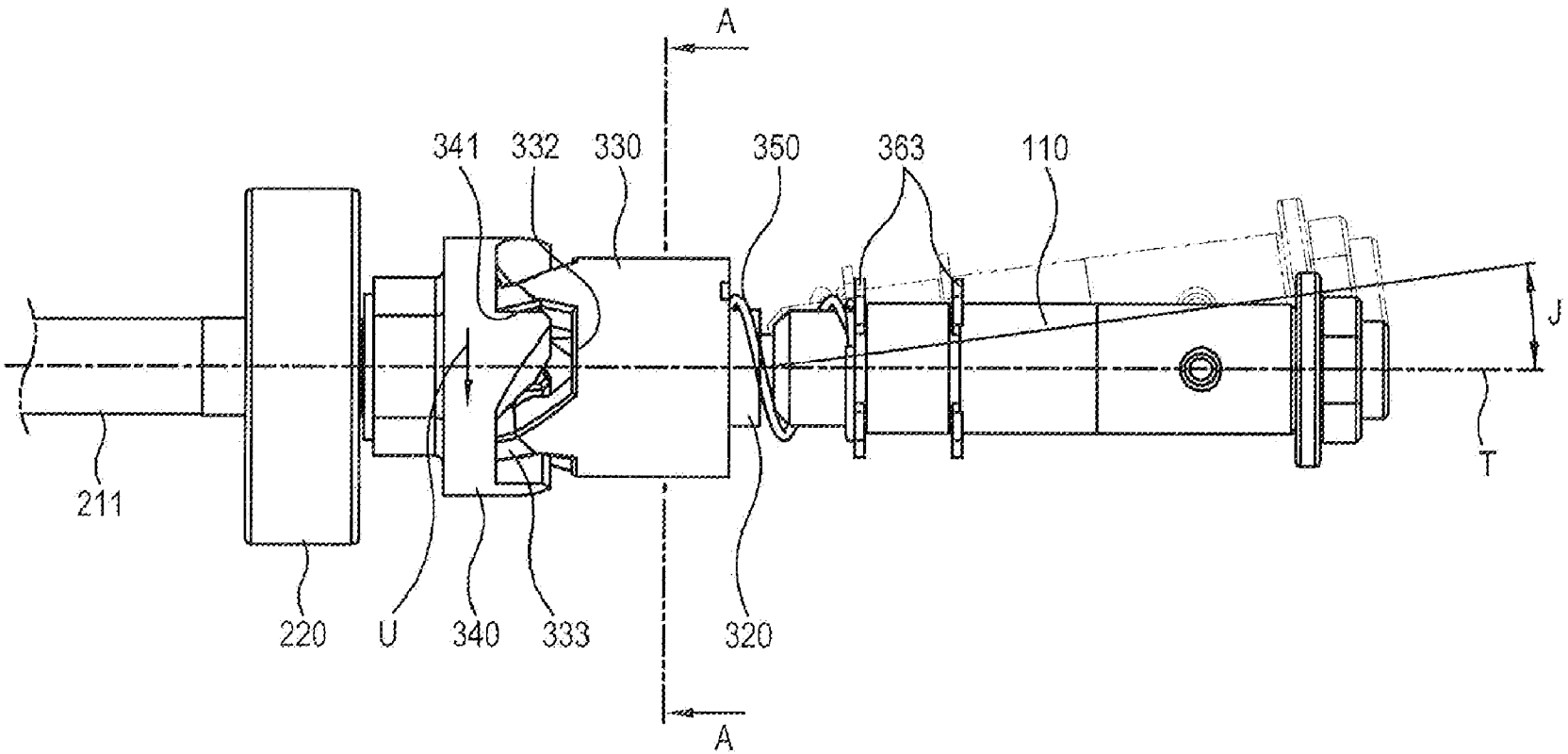
FIG. 5 is an assembled view of the power transmission unit of FIG. 4.

FIG. 4 is an exploded perspective view of the power transmission unit 300 provided on a power transmission path from the driving shaft 110 to the image carrying body 210 of the developing cartridge 200. FIG. 5 shows relevant elements of the power transmission unit 300 assembled together.

The passive coupler 340 may be coupled to a D-cut portion 211*a*, which is an end of the image carrying body shaft 211 cut to have a 'D' shaped cross-section.

The passive coupler 340 may include a plurality of passive projections 341 protruding from a base surface 341*c* toward the driving coupler 310. The passive projections 341 may also be referred to hereinafter as passive tips.

Each passive projection 341 may include a downward inclined surface 341*b* for guiding an axial projection 333 (which will be described later) of the driving coupler 310 toward the base surface 341*c* of the passive coupler 340 and a contact surface 341*a* for contacting the axial projection 333.

The driving coupler 310 may include a plurality of axial projections 333 protruding from the surface 332 toward the contact surface 341*a* along the rotational axis line T of the driving shaft 110. According to an embodiment, the surface 332 may be arranged so that a line normal to the surface 332 is parallel to the rotational axis line T of the driving shaft 110.

The plurality of axial projections 333 may in a point-contact with the respective ones of the plurality of contact surfaces 341*a* provided in the passive projections 341 along the rotational direction U of the driving shaft 110. The plurality of axial projections 333 may also be referred to herein as driving tips.

According to an aspect of the present disclosure, and as will further described later, even when the image carrying body shaft 211 and the driving shaft 110 were to be misaligned with respect to each other, that is, even when their respective rotational axes do not coincide, the plurality of axial projections 333 and the plurality of contact surfaces 341*a* can remain in the point-contact with one another. Thus, a stable transmission of the torque may still be possible even when the respective rotational axes of the driving shaft 110 and the image carrying body shaft 211 become misaligned with respect to each other due to component and assembly tolerance and/or vibration, etc.

As shown in FIGS. 4 and 5, the driving coupler 310 may include a primary coupler 320 which is coupled to the driving shaft 110 such that it rotates integrally with the driving shaft 110 and a secondary coupler 330 moveable along the direction of the rotational axis line T of the driving shaft 110 with respect to the primary coupler 320. The secondary coupler 330 may be configured to make point-contacts with the primary coupler 320 along the rotational direction U.

The driving coupler 310 and the driving shaft 110 may be coupled a driving unit (not shown), which may be installed to the main body 1. As shown in FIG. 4, and in FIG. 6 in greater detail, the plurality of axial projections 333 may be formed in the secondary coupler 330.

Figure 10:
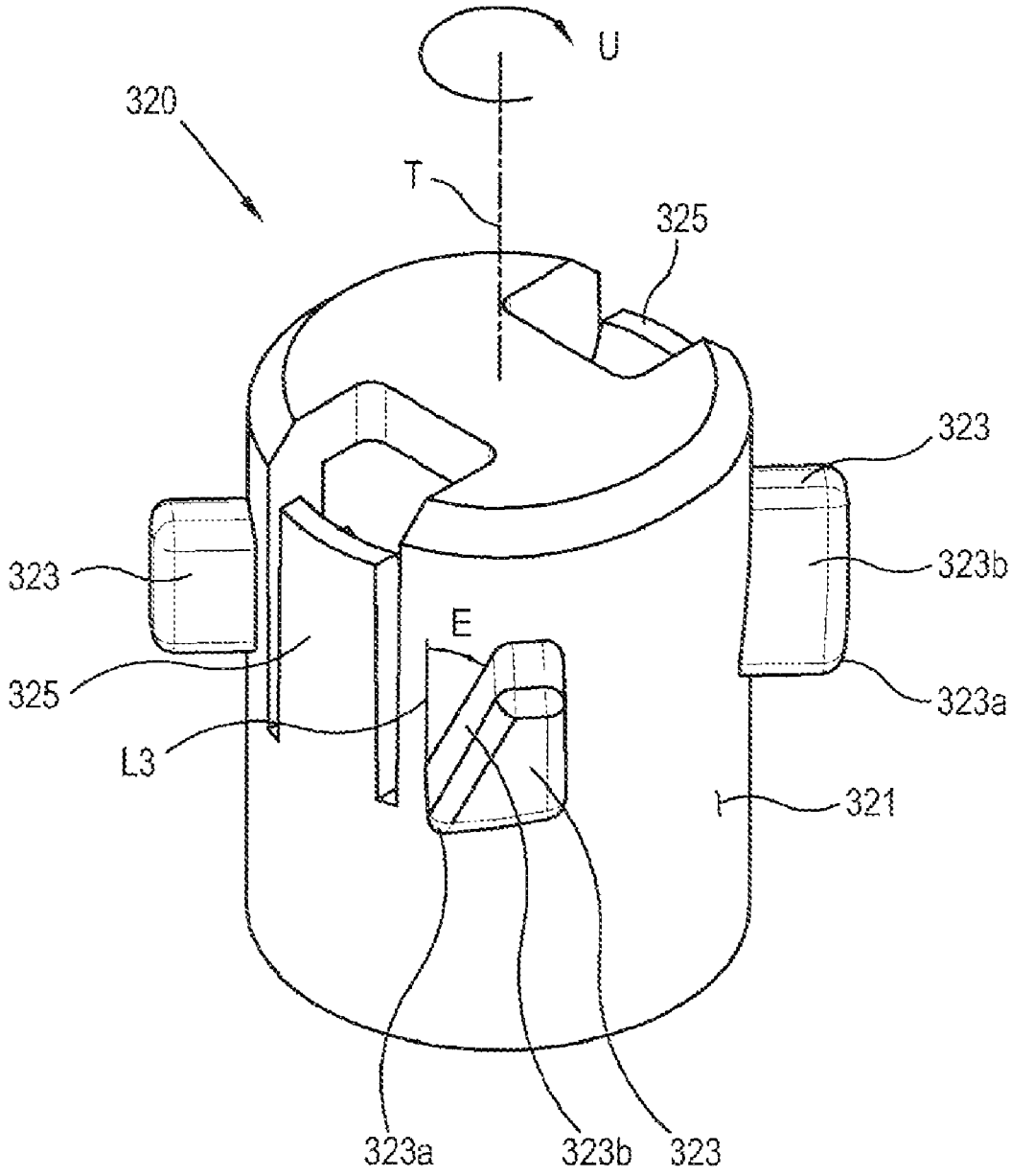
FIG. 10 is an enlarged perspective view of a primary coupler of the power transmission unit of FIG. 4.
Figure 11:
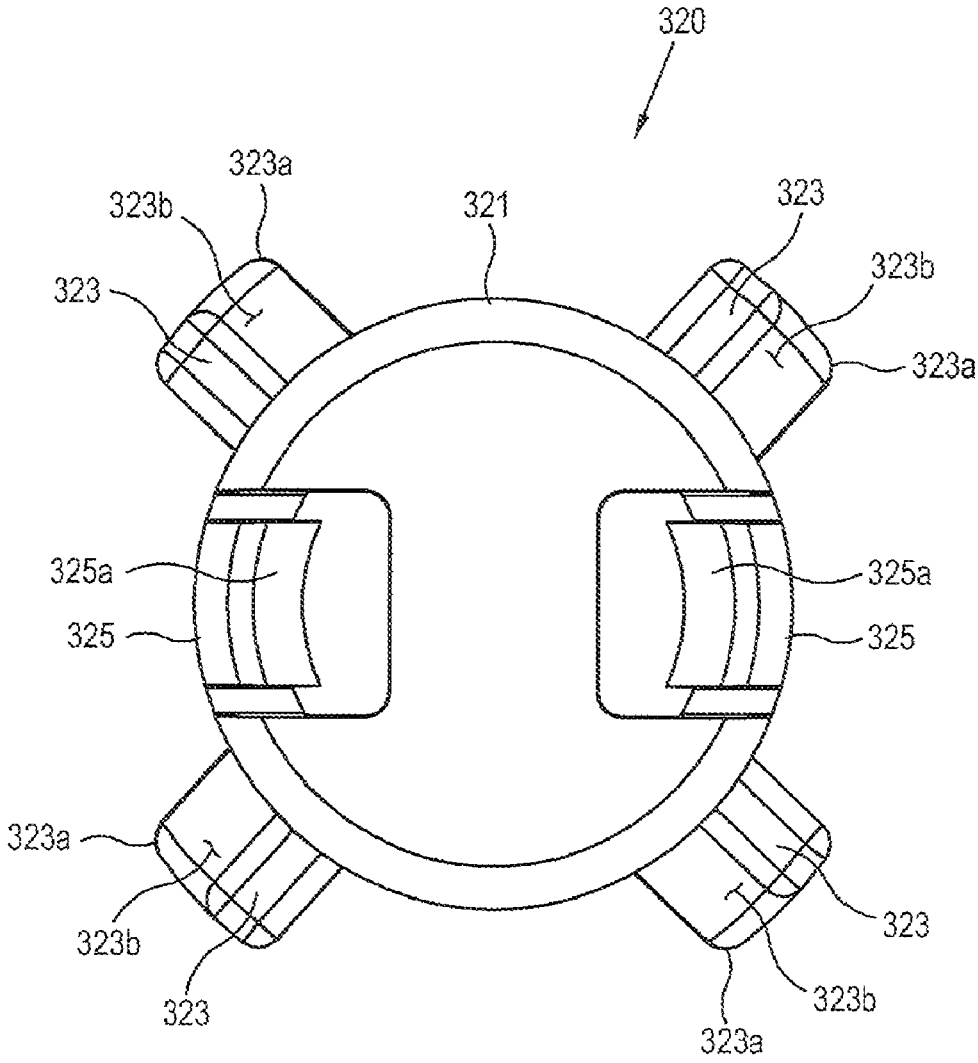
FIG. 11 is an enlarged plan view of the primary coupler of FIG. 10.

As shown in FIGS. 10 and 11, the primary coupler 320 may include a plurality of circumferential projections 323 protruding radially outward from an outer surface 321 thereof.

Figure 7A:
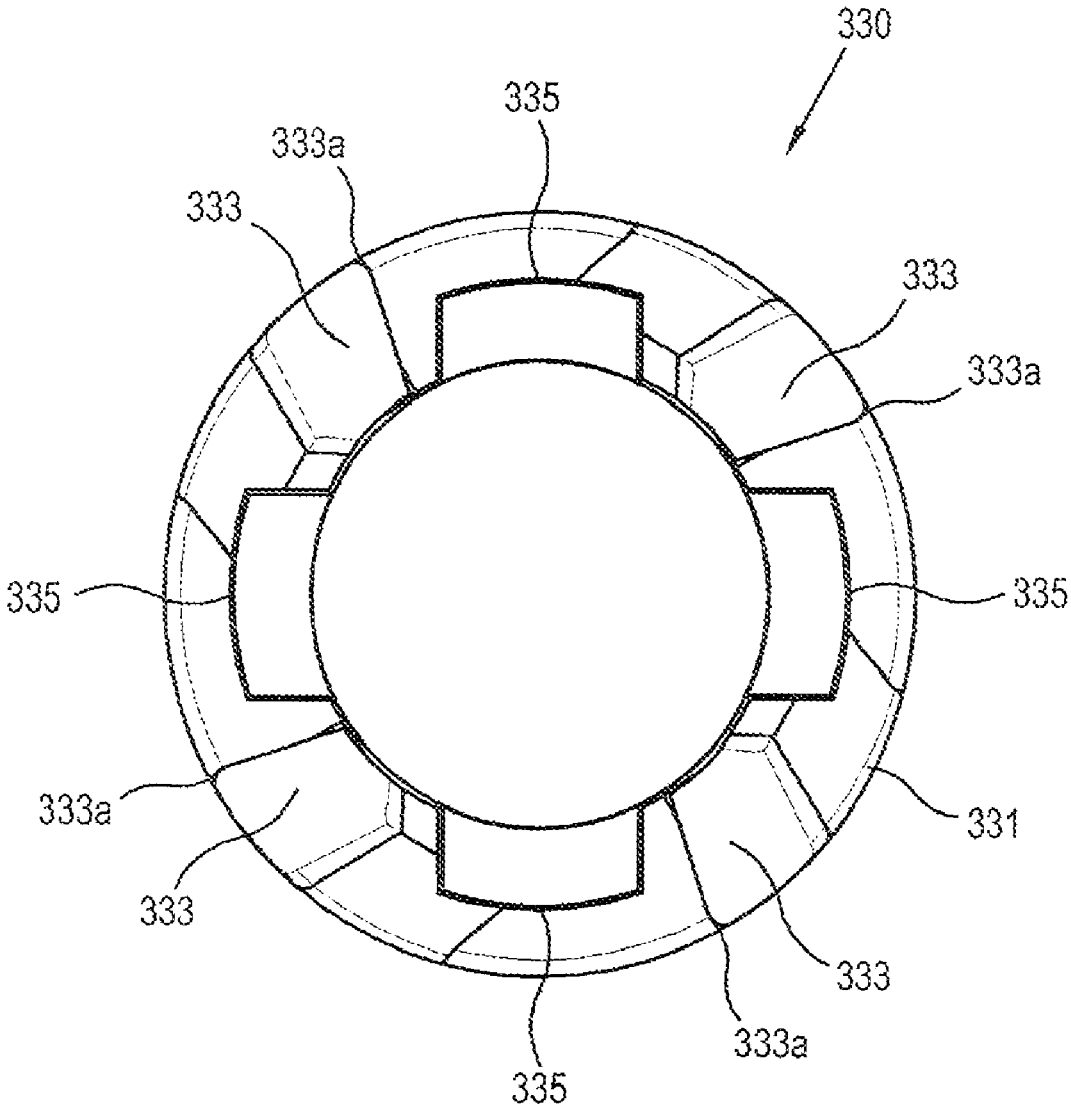
FIG. 7A is a plan view of the secondary coupler of FIG. 6.
Figure 7B:
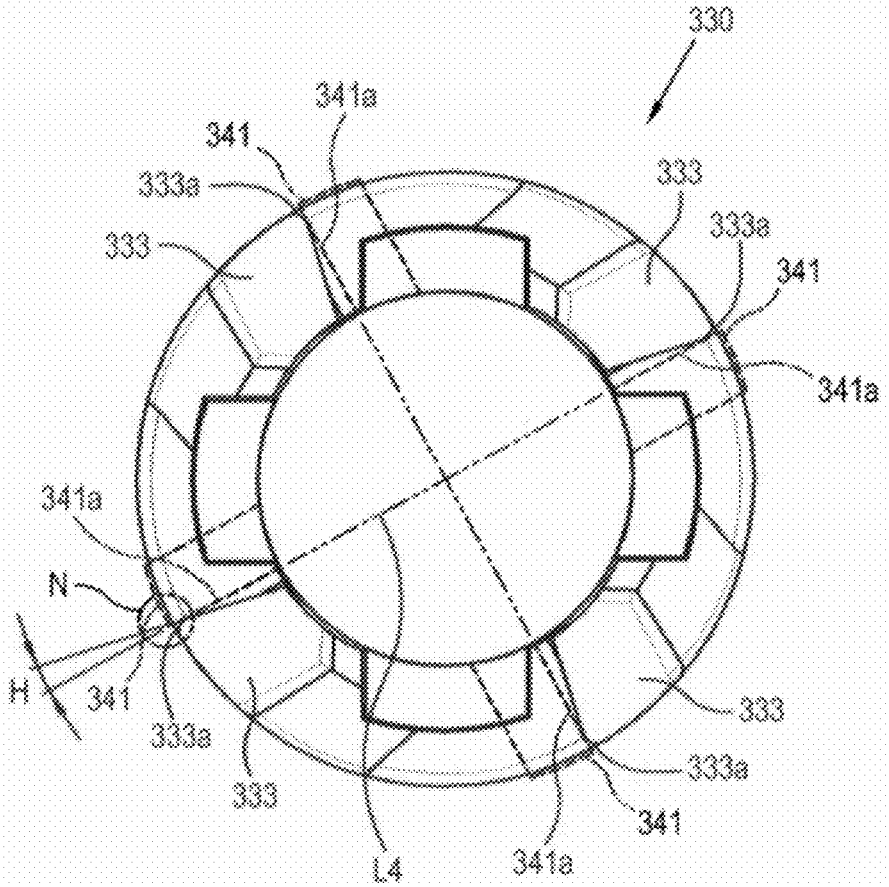
FIG. 7B is a view illustrative of the relationship between an axial projection of the secondary coupler of FIG. 6 and a contact surface of a passive coupler of FIG. 4.

As illustrated in FIGS. 7A and 7B, the secondary coupler 330 may include a plurality of accommodating grooves 335 for accommodating therein the plurality of circumferential projections 323 of the primary coupler 320 in such a manner as to be in contact with the plurality of circumferential projections 323.

Referring to FIGS. 4, 6, 7A and 7B, the driving coupler 310, particularly, the manner in and the structure of which the plurality of axial projections 333 of the secondary coupler 330 and the plurality of contact surfaces 341 of the passive coupler 340 are in the point-contact with each other, will now be described in greater detail.

The plurality of axial projections 333 may include point-contact parts 333*a* to be in the point-contact with the respective ones of plurality of contact surface 341*a* of the passive coupler 320. As will be further described below, the point-contact part 333*a* may be the portion of the axial projection 333 that protrudes the furthest in the direction toward where the contact surface 341*a* would be when the secondary coupler 330 and the passive coupler 340 are operably engaged.

Figure 6:
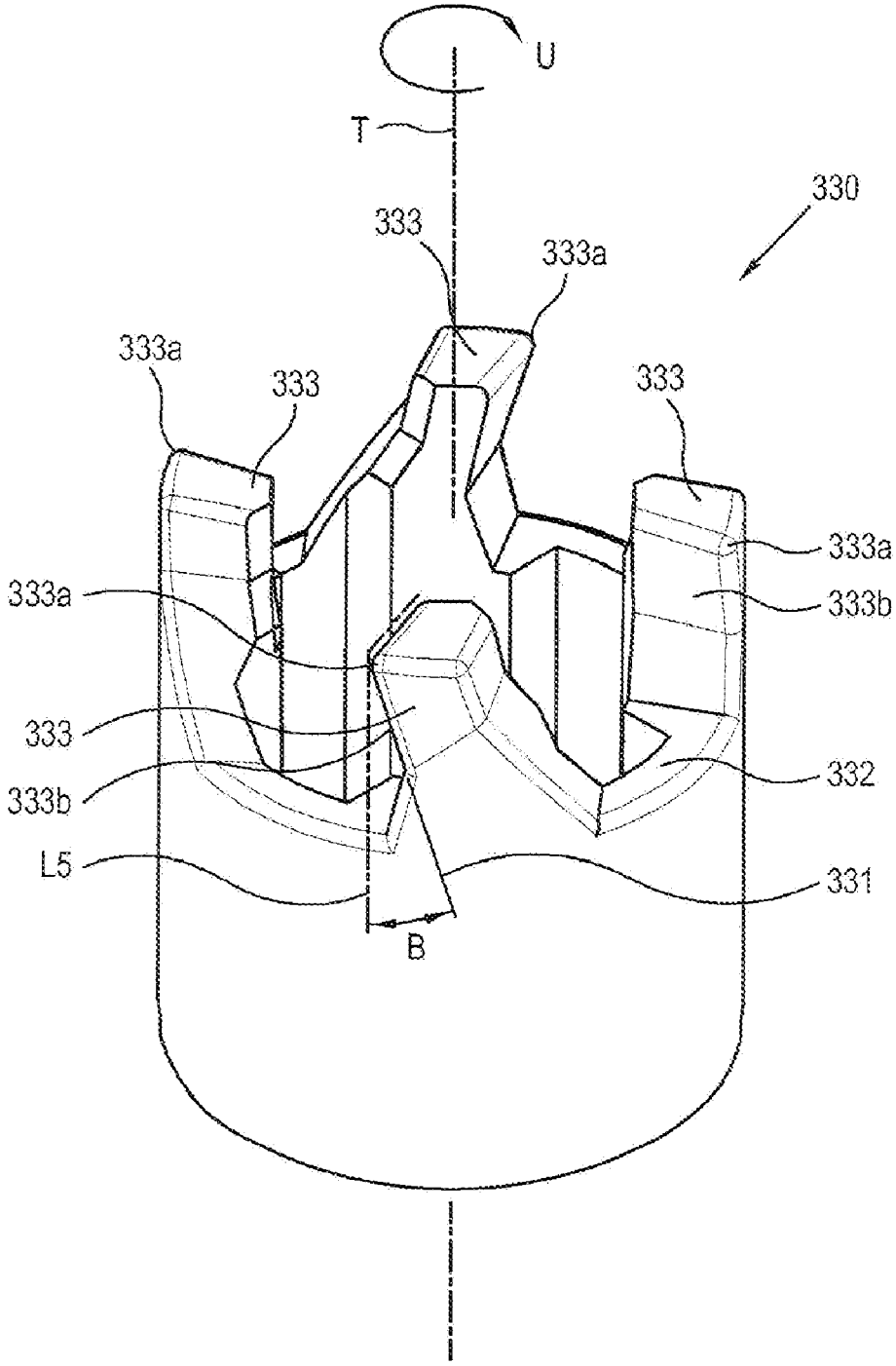
FIG. 6 is an exploded perspective view of a secondary coupler of the power transmission unit of FIG. 4.

As shown in FIG. 6, a longitudinal line L5 (i.e., extending parallel to the rotational axis of the secondary coupler 330) that intersects a point-contact part 333*a* may be inclined at a lengthwise angle B with respect to the line 331 on the surface 333*b* of the corresponding axial projection 333. According to an embodiment, the lengthwise angle B may be an acute angle, i.e., greater than 0 degree but less than 90 degrees.

Further, as shown in FIGS. 7A and 7B, in each of which are shown portions of the secondary coupler 330 and the passive coupler 340 as they are operably engaged with each other, a radial line L4 that passes through the point-contact part 333*a* may be inclined at an angle H with respect to the surface 333*b* of the axial projection 333. According to an embodiment, the angle H may be an acute angle.

With the above described configuration, the point-contact part 333*a* may thus be the portion of the axial projection 333 that extends the furthest circumferentially toward the contact surface 341*a* in the direction of the rotation U of the secondary coupler 330 with respect to both in the radial direction orthogonal to the rotational axis T and in the longitudinal direction parallel to the rotational axis T so that the point-contact part 333*a* can come into a point-contact with the contact surface 341*a* , as shown in area "N" of FIG. 7B.

A "point-contact" as herein referred may a manner in which a contact with a surface is made using a protruding contact structure so that the contact is made substantially at a point or at a small localized region of the surface being contacted as opposed to a line contact in which the contact occurs along a continuous line across a substantial portion of the surface or to a surface contact in which the contact occurs over the substantial portion of the surface. The actual size of the localized region of contact may depend on the desired degree of precision or of the uniformity in the transmission of the rotational force. According to an aspect of the present disclosure, the point-contact may provide a more uniform contact region during operation with respect to the radial direction of the rotational axis T than that of a line contact or of a surface contact, and may thus allow the passive coupler 340 to rotate at a constant angular velocity to the extent the driving coupler 310 rotates at a constant angular velocity. Such constant angular velocity of the passive coupler 340 may be difficult to realize when the contact region is allowed to vary significantly during operation.

By way of an illustrative example, assume that an axial projection 333 has a lengthwise angle B of 10 degrees between the longitudinal line L5 passing through the point-contact part 333*a* and the surface 333*b*, and that an angle H of 0 degree is formed between the radial line L4 passing through the point-contact part 333*a* and the surface 333*b*. In such case, the radial line L4 may extend substantially along the radial edge of the axial projection 333 such that the such radial edge may be in a line-contact with the contact surface 341*a* along the line L4. That is, a continuous line along the radial direction edges of the plurality of axial projections 333 may be in a line contact with the contact surface 341*a*. Accordingly, the plurality of axial projections 333 may be in line-contacts with the respective ones of the contact surface 341*a* of the passive coupler 340 along the radial direction of the secondary coupler 330. With such a line contact along the radial direction, the contact region for the transmission of power may vary along the line contact, and may thus not be uniform during operation.

Assume, on the other hand, that the axial projection 333 has a lengthwise angle B between the line L5 passing through the point-contact part 333*a* and the surface 333b is 0 degree, and that the angle H between the radial line L4 and the surface 333*b* is 30 degrees, In this case, the axial projection 333 contacts the contact surface 341*a* along the line L5. In other words, a longitudinal edge of the axial projection 333 is in a line-contact with the contact surface 341*a* of the passive coupler 340 along the lengthwise direction of the secondary coupler 330. In such configuration, the contact region realized through the line contact along the lengthwise direction may be somewhat more uniform than that of the line contact along the radial direction of the previous example. However, when the driving shaft 110 and the image carrying body shaft 211 become misaligned with respect to each other, for example, if one of them swerves or moves in the radial direction, the contact region for the transmission of power may be more likely to vary to a greater extent than that of the point contact since the line contact allows a larger range within which the contact region may vary.

As described above, according to one or more embodiments of the present disclosure, the point-contact part 333*a* may be inclined in terms of both the radial direction and in the longitudinal direction parallel to the rotational axis line T, and thus may protrude furthest toward the contact surface 341*a* with respect to the rotational direction U about the rotational axis line T. In other words, the plurality of axial projections 333 protrudes from the surface 332 of the secondary coupler 330 in the axial direction in part and in the circumferential direction in part, to thereby form, for example, a twisted helix, such that the point-contact parts 333*a* of each of the axial projections 333 can protruded the furthest toward the respective corresponding one of the contact surface 341*a*.

While, in the above descriptions, the contact surface 341*a* and the axial projection 333 are shown and described as being formed in the passive coupler 340 and the driving coupler 310 (specifically, the secondary coupler 330), respectively, the arrangement of the contact surface 341*a* and the axial projection 333 need not be so limited. The axial projections and the contact surfaces may alternatively be formed in the passive coupler and the driving coupler, respectively.

Figure 8:
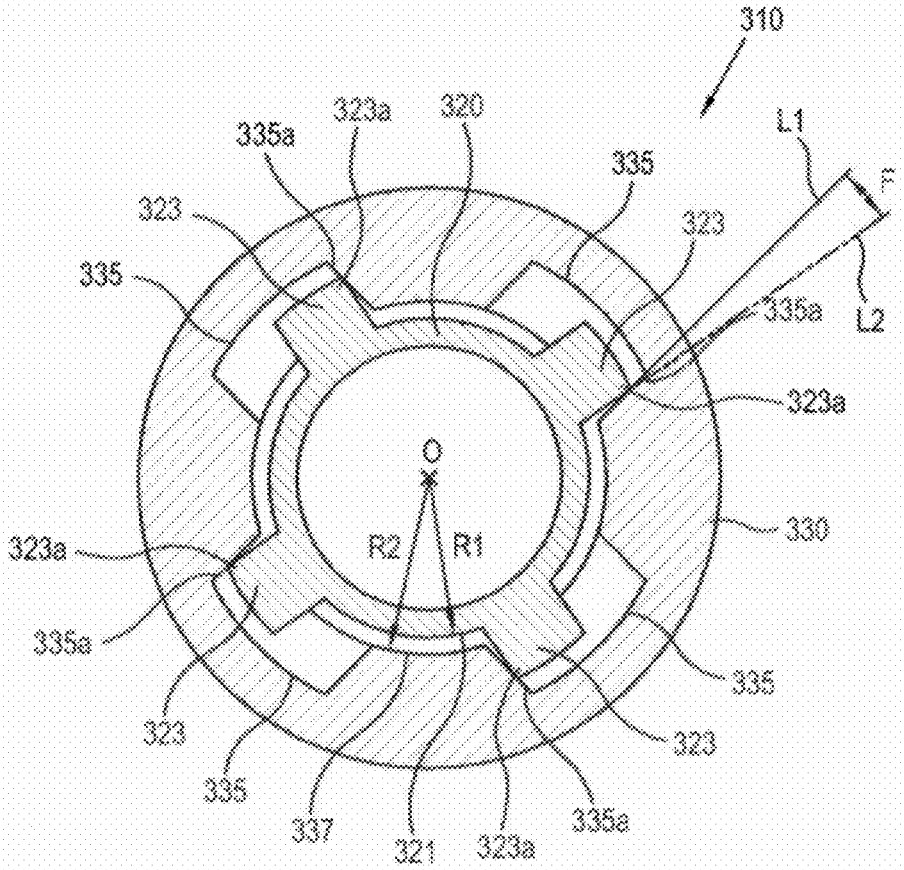
FIG. 8 is a cross-sectional view taken along the line A-A of FIG. 5.

The structure and configuration of the point-contacts between the plurality of accommodating grooves 335 of the secondary coupler 330 and the plurality of circumferential projections 323 of the primary coupler 320 will now be described with reference to FIGS. 5 and 8 to 11, of which FIG. 8 is a sectional view taken along line A-A of FIG. 5.

The plurality of accommodating grooves 335 may each be formed with the contact surfaces 335*a* for contacting the respective one of the plurality of circumferential projections 323.

The plurality of circumferential projections 323 may each have a point-contact part 323*a* for making a point-contact with the respective corresponding one of the contact surfaces 335*a*. According to an embodiment, the point-contact part 323*a* may be the portion of the circumferential projection 323 that protrudes the furthest toward the contact surface 335*a* along the rotational direction U.

Figure 9:
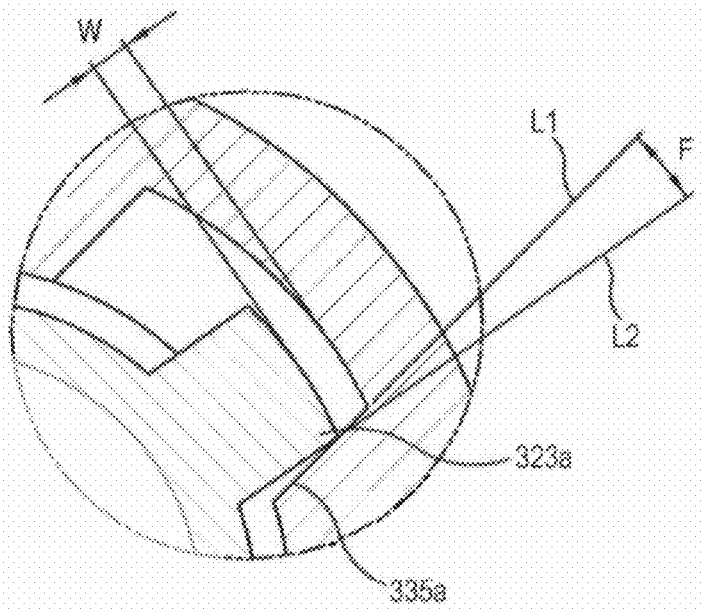
FIG. 9 is an enlarged view of a portion of the cross-section shown in FIG. 8.

To that end, as shown in FIGS. 8 and 9, the radial direction line L2 passing through the point-contact part 323*a* of the circumferential projection 323 may form an angle F with the line L1 that extends along the contact surface 335*a*. Accordingly, the point contact part 323*a* may be in a point-contact with the contact surface 335*a* with respect to the rotational direction U. FIG. 9 is an enlarged section view of FIG. 8, which illustrates the angle F formed between the lines LI and L2 in greater detail.

According to an embodiment, the point-contact part 323*a* shown in FIGS. 8 and 9 may be arranged to be a line-contact with the contact surface 335*a*, which line-contact extends along the lengthwise direction parallel to the rotational axis of the secondary coupler 330.

According to an alternative embodiment, the point-contact part 323*a* of the circumferential projection 323 may be arranged to be in a point-contact with the contact surface 335*a* even in the lengthwise direction, i.e., parallel to the rotational axis T. To that end, according to an embodiment, the circumferential projection 323 further includes an inclined surface 323*b* that is inclined at an inclined angle E with respect to a line L3 extending along the lengthwise direction as shown in FIG. 10 so that the point-contact part 323*a* can come into a point-contact with the contact surface with respect to both the radial and parallel directions with respect to the rotational axis T. According to an embodiment, the inclined angle E between the inclined surface 323*b* and the rotational axis line T may be an acute angle greater than 0 degree.

As shown in FIG. 8, according to an embodiment, the radius R1 from the radial center O to the outer surface 321 of the primary coupler 320 may be smaller that the radius R2 from the radial center O to the inner surface 337 of the secondary coupler 330 such that there may be provided a gap in the radial direction between the outer surface 321 of the primary coupler 320 and the inner surface 337 of the secondary coupler 330.

Further, as shown in FIG. 9, there may be provided a gap W between the outer top surface of the circumferential projection 323 and the inner circumferential surface of the accommodating groove 335.

With the above described configuration, the primary coupler 320 may have a freedom of movement in all three dimensions with respect to the secondary coupler 330. That is, the gap (R2–R1) between the outer surface 321 and the inner surface 337 and the gap W in the radial direction between the circumferential projection 323 and the accommodating groove 325 may allow pivoting movements of the primary coupler 320 radial as well as about the rotational axis T.

More specifically, the primary coupler 320 can not only rotate about the rotation axis T in relation to the secondary coupler 330, but can also rotate or pivot about a rotational axis perpendicular to the rotational axis T within a predetermined angle range before coming into an interfering contact with the secondary coupler 330. For example, if the rotational axis T is along the Z-axis, the secondary coupler 330 can rotate within a range of angle about any rotational axis that extends along the X-Y plane. Thus, the primary coupler 320 or the driving shaft 110 may rotate three-dimensionally to some extent with respect to the secondary coupler 330.

With the three-dimensionally degree of freedom of the driving shaft 110 with respect to the secondary coupler 330, the second coupler 330 can absorb some misalignment between the driving shaft 110 and the image carrying body shaft 211, and can maintain contact with the passive coupler 340 notwithstanding such misalignment. That is, for example, even when the respective axes of rotation of the driving shaft 110 and the image carrying body shaft 211 are misaligned and thus intersect with each other at a predetermined angle J as shown in FIG. 5, each of the plurality of point-contact parts 333*a* of the secondary coupler 330 can remain in contact with the plurality of contact surface 341*a* of the passive coupler 340. Accordingly, with the above configuration, an effective transmission of the motive power from the driving coupler 310 to the passive coupler 340 as well as the maintenance of uniform contact regions between the point-contact parts 333*a* and the contact surfaces 341*a* may be realized, thereby resulting in the reduction in the variation of the rotational-speed of the image carrying body 210.

According to an embodiment, the lengthwise angle B (refer to FIG. 6) of the plural point-contact parts 333*a* of the secondary, coupler 330 may be larger than the angle J at which the driving shaft 110 intersects the image carrying body shaft 211. That is, the amount or a range of protrusion by which the point-contact part 333*a* is to protrude circumferentially in the rotational direction U of the image carrying body shaft 211 may be determined in consideration of the angle J.

For example, if it is assumed that the intersection angle J is expected to be about 5 degrees, the lengthwise angle B may be set as an angle greater than 5 degrees, for example, about 7 degrees. In such example, although the driving shaft 110 may become tilted with respect to the image carrying body shaft 211 by as much as the intersection angle J of 5 degrees, the axial projection 333 of the driving coupler 310 protrudes in the circumferential by a sufficient amount so as to allow the axial projection 333 to maintain the point-contact with the contact surface 341*a* of the passive projection 340 despite such tilting of the driving shaft 110.

According to an embodiment, the inclined angle E of the inclined surface 323*b* of the primary coupler 320 (see FIG. 10) may be greater than the intersection angle J so that the secondary coupler 330 and the primary coupler 320 of the driving coupler 310 can be in the point-contact with each other despite the tilting of the driving shaft by up to the intersection angle J.

The coupling relationship between the driving shaft 110, the image carrying body shaft 211 and the power transmission unit 300 according to an embodiment will now be described with reference to FIGS. 4 and 12.

Figure 12:
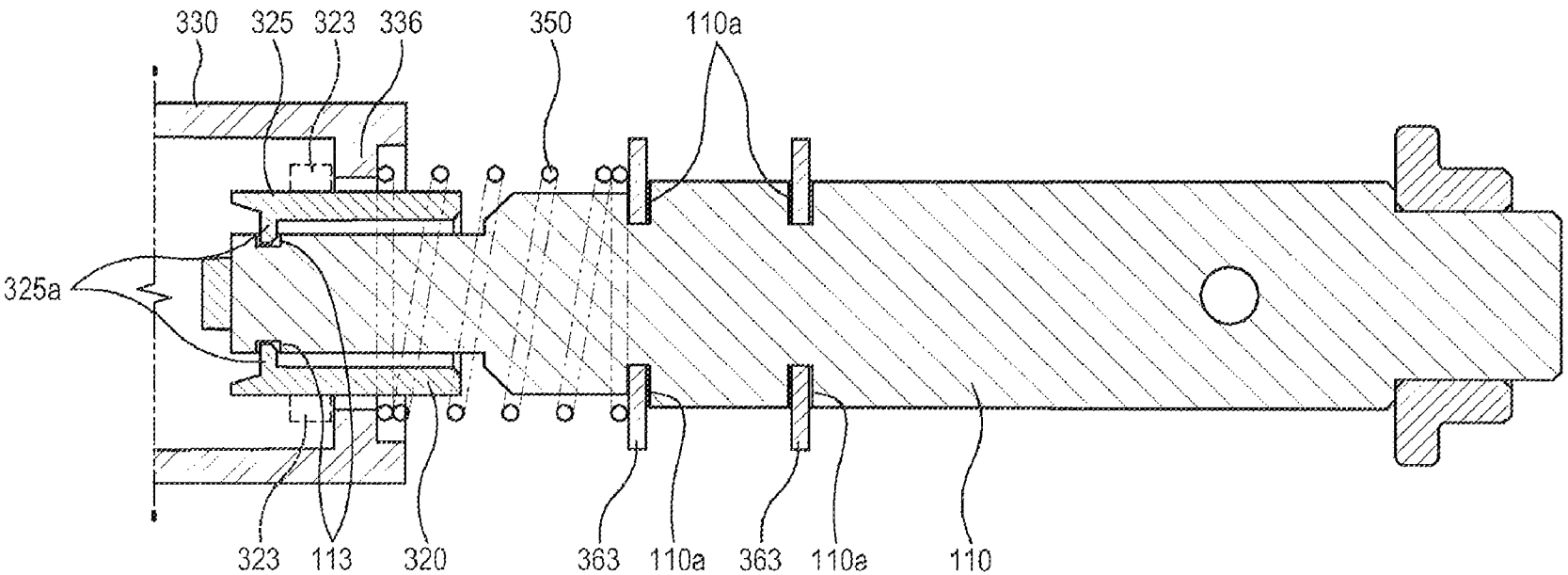
FIG. 12 is a longitudinal sectional view of relevant portions of the power transmission unit of FIG. 5.

As shown in FIGS. 4 and 12, the driving shaft 110 may be provided with two elastic member supporting washers 363 for supporting an elastic member 350. The elastic member supporting washers 363 may be received in and thus coupled to grooves 110*a* formed on the driving shaft 110.

The elastic member 350 may elastically bias the secondary coupler 330 of the power transmission unit 300 along the rotational axis line T in the direction toward the passive coupler 340.

The elastic member 350 may have one end thereof supported by an elastic member supporting washer 363 while the other end may be supported by an elastic member seating part 336 of the secondary coupler 330. The elastic member seating part 336 may protrude inward from the inside surface of the secondary coupler 330.

The primary coupler 320 may be coupled, via a coupling portion 326, to the driving shaft 110 through the insertion projection groove 113 formed at the end portion 115 of the driving shaft 110. To that end, the primary coupler 320 may further include a catch coupling part 325 that may be engagingly received in the insertion projection groove 113 (refer to FIGS. 4, 10, 11 and 12).

The catch coupling part 325 may further includes an insertion projection 325*a* protruding inward. According to an embodiment, the insertion projection 325*a*may have an inclined bottom surface. As illustrated in FIG. 10, according to an embodiment, the catch coupling part 325 may be provided as a partial cut out portion of the well of the primary coupler 320. When the driving shaft 110 is received into the primary coupler 320, the inclined bottom surface of the insertion projection 325*a* comes into a contact with the end portion of the driving shaft 110 to thereby open up the catch coupling part 325.

By way of illustrative example, the coupling the driving coupler 310 to the driving shaft 110 may be achieved as follows. First, the elastic member supporting washer 363 may be installed in the groove 110*a* of the driving shaft 110.

The elastic member 350 may then be placed on the driving shaft 110 so that the first end thereof can be supported by the elastic member supporting washer 363.

Next, the secondary coupler 330 of the driving coupler 310 may be installed on the driving shaft 110 so that the second end of the elastic member 350 is supported by the elastic member seating part 336 of the secondary coupler 330.

Then, the primary coupler 320 may be placed to slide over the end portion of the driving shaft 110 until the insertion projection 325*a* of the primary coupler 320 engages the insertion projection groove 113 of the driving shaft 110.

When assembled together, for example, through the above-outlined procedure, the secondary coupler 330 may be elastically biased toward the passive coupler 340 by the elastic member 350, but may be restricted in its movement due to the elastic member seating part 336 of the secondary coupler 330 being in an interfering contact with the circumferential projection 323 protruding from the outer surface of the primary coupler 320. That is, according to an embodiment, the circumferential projection 323 may serve as a stopper to limit the movement of the secondary coupler 330 in the direction of the rotational axial line T.

Figure 13:
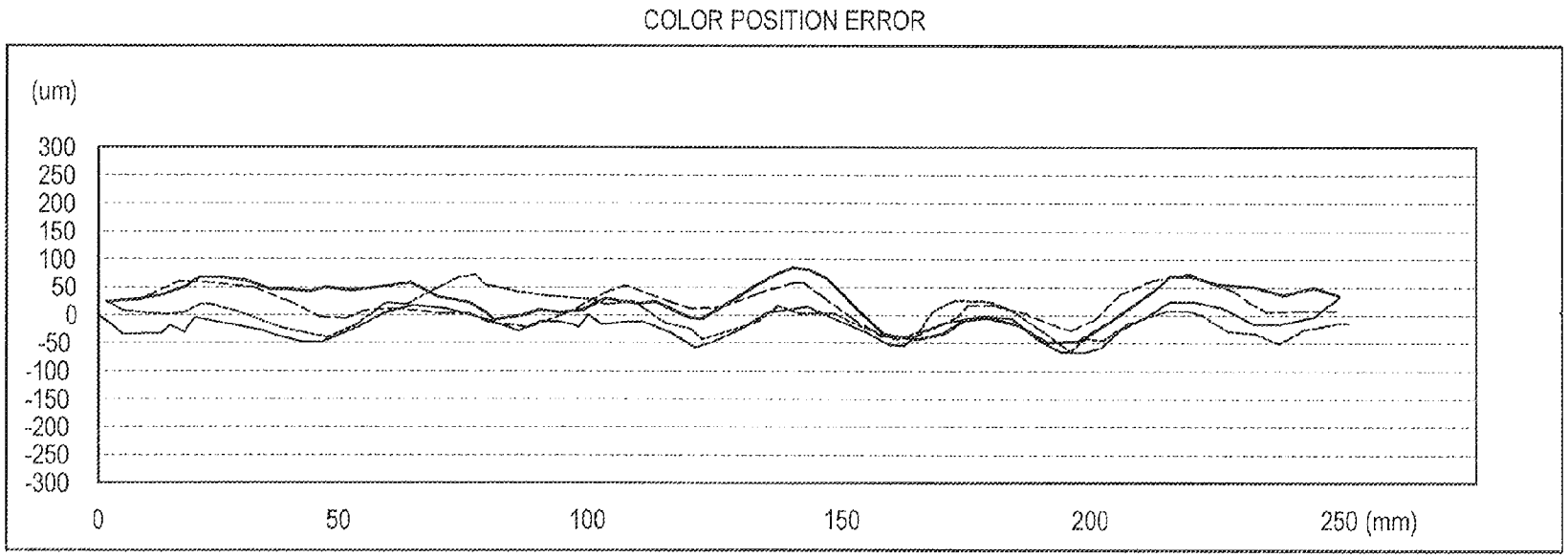
FIGS. 13 and 14 are graphs illustrative of the color positional errors of the image forming apparatus according to an embodiment of the present disclosure.
Figure 14:
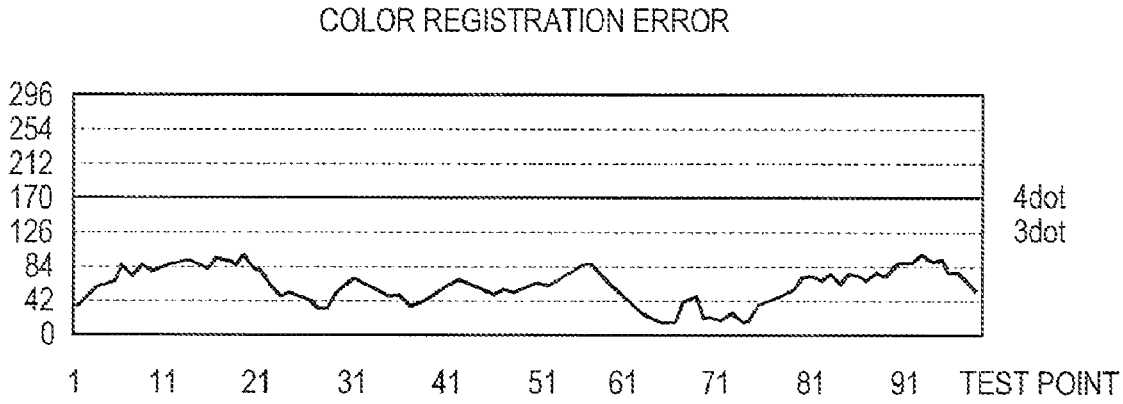

FIGS. 13 and 14 are graphs showing results of an experiment for determining the position error and a registration error of Y, M, C and K colors of the image forming apparatus 100 according to an embodiment of the present disclosure. The methodology for the experiment was substantially the same as the previously described testing of the conventional image forming apparatus, results of which are shown in FIGS. 1 and 2.

Figure 2:
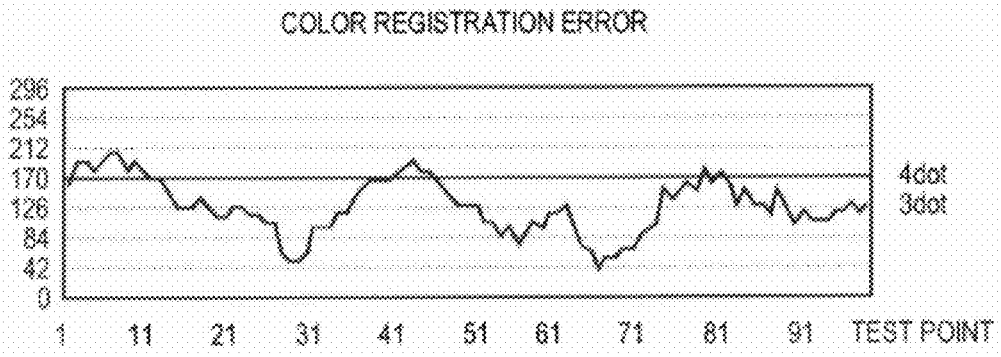
FIG. 2 (RELATED ART)

Comparing the results shown in FIG. 13 with the results shown in FIG. 1, and the results shown in FIG. 14 with the results shown in FIG. 2, it can be appreciated that a significant improvement in the color registration was observed for the image forming apparatus of the configuration according to one or more embodiments herein described.

Such improvement in the color registration may be attributable to the reduction in the positional errors realizable in the image forming apparatus 100 according to the embodiments, in which the driving coupler 310 and the passive coupler 320 are in the point-contact with each other, and in which the driving coupler 310 (specifically, the plurality of axial projections 333 of the second coupler 330) can move with the three dimensional freedom of movement with respect to the driving shaft 110.

With such configuration, even when the driving shaft 110 and the driven shaft 211, e.g., the rotational shaft of image carrying body shaft, become misaligned with respect to each other, such misalignment can be mitigated to maintain the contacts between the plurality of axial projections 333 of the driving coupler 310 and the contact surface 341 of the passive coupler 340 substantially uniform.

Such an improved structure of the power transmission unit 300 according to one or more embodiments of the present disclosure significantly decreases the color registration error. In particular, referring to FIG. 14, for the case of an image forming apparatus according to an embodiment herein, the maximum color registration error observed was about 102 μm with no test point (0%) having a color registration error of 126 μm or larger whereas, in comparison, in the case of a conventional image forming apparatus, as shown in FIG. 2, the maximum color registration error was about 210 μm with 41.4% of 100 test points having a color registration error of 126 μm (corresponding to three dots for a resolution of 600 dpi) or larger. Accordingly, a significant reduction in the color registration error can be achieved in an image forming apparatus of a configuration according to an aspect of the present disclosure, An example of such image forming apparatus 100 employing the power transmission unit according to one or more embodiments of the present disclosure will now be described in greater detail with reference to FIG. 15.

Figure 15:
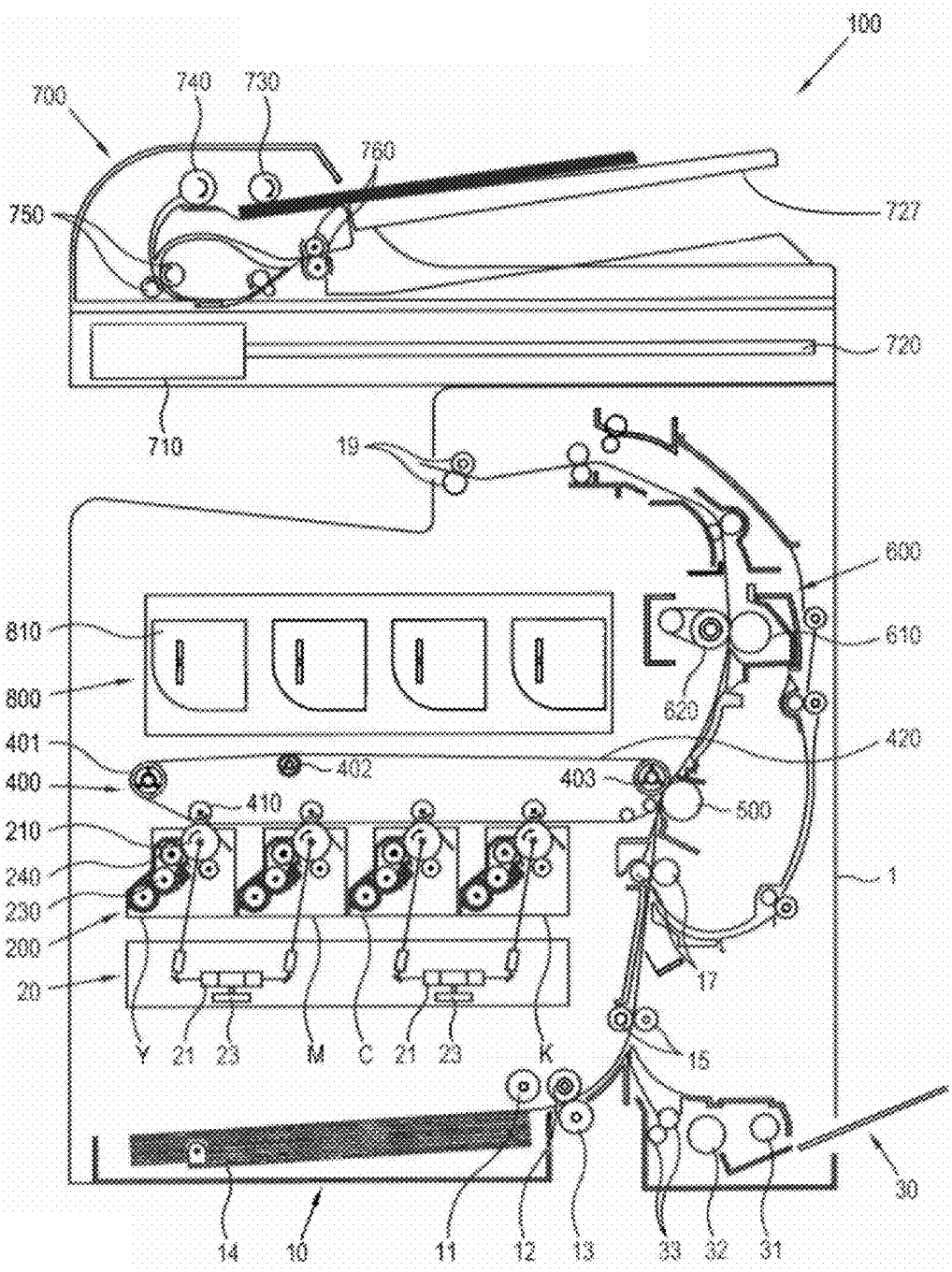
FIG. 15 is a schematic sectional view of the image forming apparatus according to an embodiment of the present disclosure.

As shown in FIG. 15, the image forming apparatus 100 according to an embodiment may include a medium supplying unit 10 for supplying a print medium along a print medium path inside the image forming apparatus 100; a manual medium supplying unit 30 for supplying the print medium that is manually placed thereon; an exposure unit 20; developing cartridges 200, an intermediate transfer unit 400; a transfer roller 500; a fixing unit 600; discharging rollers 19 and a developer tank 800.

The exposure unit 20 may be configured to expose the image carrying bodies 210 of the developing cartridges 200 to light. That is, the controller (not shown) of the image forming apparatus may receive an exposure signal corresponding to the image to be printed, and exposures the outer surfaces of the image carrying bodies 210 in accordance with the exposure signal.

Specifically, the exposure unit 20 may include a light source (not shown) for emitting light; one or more polygon mirrors 21 each directing the light emitted from the light source (not shown) toward the image carrying body 210 and one or more driving motors 23 for rotationally driving the polygon mirrors 21.

The exposure unit 20 may expose the image carrying bodies 210 according to the respective color of developer to be applied to the corresponding image carrying body 210. For example, the image carrying body 210 associated with the developing cartridge Y that stores the yellow colored developer is exposed to light that contains or is modulated with information relating to the yellow color portion of the overall color image to be printed. As a result of such light exposure, an electrostatic latent image is formed as a pattern of electrical potential difference between exposed and non-exposed portions of the surface of such image carrier body 210. The developing roller 240 receives the yellow colored developer conveyed by feeding roller 230 from the supply of developer stored in the developing cartridge Y, and applies the received developer to the image carrier body 210 to thereby develop the electrostatic latent image into a visible image of yellow color on the surface of the image carrier body 210. The remaining three developing cartridges M, C and K may operate substantially similarly to form visible images of magenta, cyan and black, respectively, on the image carrier body 210 associated therewith.

The four developing cartridges 200 may each receive the corresponding color developer stored in the respective corresponding one of the developer cartridges 810 of the developer tank 800 arranged above the intermediate transfer unit 400 through developer supplying pipes (not shown). Each developer cartridge 810 may store the developer of a particular color corresponding to one of the developing cartridges 200. Each developer cartridge 810 may be detachably received in the main body 1 of the image forming apparatus 100 so that it can be replaced or replenished when the developer stored therein is used up.

As shown in FIG. 15, the four developing cartridges 200 may be arranged in a sequential order, e.g., Y, M, C and then K, along the direction of movement of an intermediate transfer belt 420 of the intermediate transfer unit 400. It should be noted that the particular order of the four developing cartridges 200 depicted in FIG. 15 is merely an illustrative example, and that the developing cartridges 200 can be arranged in any other order.

The intermediate transfer unit 400 may include intermediate transfer rollers 410 each facing the respective corresponding one of the image carrying bodies 210 with the intermediate transfer belt 420 interposed therebetween; and may further include a plurality of driving rollers 401, 402 and 403 for rotationally driving the intermediate transfer belt 420.

According to an embodiment, the intermediate transfer unit 400 may be mounted to the main body 1 of the image forming apparatus 100 so that it can be detached or removed at least partially from the main body 1 to allow repair or replacement thereof, or to allow servicing of the image forming apparatus 100, for example, to remove a jammed print medium.

As the intermediate transfer roller 410 rotates in a loop and thus moves past each of the developing cartridges 200 in sequence, for example, in the order of Y, M, C and K as shown in FIG. 15, each individual visible image of a particular color that had been formed on each of the image carrying bodies 210 becomes sequentially transferred onto the intermediate transfer belt 420.

Such sequentially transferred images of each of the individual colors, i.e., yellow, magenta, cyan and black, are overlapped on one another on the intermediate transfer belt 420, thus forming the desired full color image. As described herein, according to an aspect of the present disclosure, the image carrying bodies 210 may be driven to rotate at uniform speed by the driving shaft 110 through the power transmission unit 300 according to one or more embodiments of the present disclosure so as to reduce the color registration in such full color image described above.

The color image may then be transferred from the intermediate transfer belt 420 to a print medium supplied from the medium supplying unit 10 or the manual medium supplying unit 30 as the print medium moves past between the intermediate transfer belt 420 and the transfer roller 500.

The medium supplying unit 10 may include a knock-up plate 14 on which the print media may be stacked; a pick-up roller 11 for picking up a print medium from the stack on the knock-up plate 14 and a plurality of conveying rollers 12 and 13 for conveying the picked-up print medium along a print medium feeding path toward the transfer roller 500. The movement of the print medium further toward the transfer roller 500 may be accomplished by the additional conveying rollers 15 and 17.

The manual medium feeding unit 30 may include a pick-up roller 32 and a plurality of conveying rollers 31 and 33, and may be alternate source of print media alternate to the medium supplying unit 10. When one or more print media are placed on the manual medium feeding unit 30, such manually placed print media may be picked up by the pick up roller 32, and may be fed by the conveying rollers 31 and 33 along the print medium feeding path toward the transfer roller 500.

The color image transferred to the print medium may become fixed onto the print medium with heat and pressure by the fixing unit 600. The fixing unit 600 may include a heating unit 620 that generates the heat and a pressing roller 610 for pressing the print medium toward the heating unit 620 so that the image, which is essentially a pattern of various colored developer, becomes fused onto the print medium by the heat and pressure.

The print medium on which the color image is fixed by the fixing unit 600 is then discharged to the outside through the discharging rollers 19.

According to an embodiment, the image forming apparatus 100 may further include a scan module 710 for scanning an image from a document; an automatic document conveying unit 700 to automatically feed the document toward the scan module 710 and a guide bar 720 for guiding the scan module 710 to move along the guide bar 720 in a reciprocating manner.

The scan module 710 may include a light source (not shown) for producing light; an image sensor 9not shown) to convert the light reflected from the document into an electrical signal in order to scan image information from the document and an optical system (not shown) for directing the reflected light from the document to the image sensor.

The scan module 710 may remain stationary while scanning a document conveyed by the automatic document conveying unit 700, and may reciprocate along the guide bar 720 when scanning a document is manually placed on a platen (not shown).

The automatic document conveying unit 700 may include a tray 727 on which the document(s) may be placed; a pick-up roller 730 for picking up a document from the tray 727; a double-conveying preventing unit 740 for separating the picked-up documents and for allowing further advancement of one document at a time, a plurality of conveying rollers 750 for convey each sheet of document past the scan module 710 and exit rollers 760 for discharging a document that has been read.

In the foregoing descriptions and in the figures, arrangements of four axial projections 333, four corresponding contact surfaces 341*a* and four circumferential projections 323 are described. However, the number of these features is not limited to four. That is, two or more of each of axial projections, contact surfaces 341*a* and circumferential projections 323 may be sufficient.

Moreover, while in the above descriptions, the power transmission unit 300 is arranged on the path of power transmission to the image carrying body 210, it should be noted that aspects of the present disclosure is not so limited, and that the power transmission unit 300 may be employed to transmit a driving force to other rotating bodies, for which an improved uniformity in the rotational speed may be desirable.

Further, in the foregoing descriptions, several examples of ways in which a point-contact structure can be achieved are provided in various references to the axial projections 333, the point-contact parts 323*a* of the circumferential projections 323 of the primary coupler 320 and the contact surfaces 335*a* of the accommodating grooves 335, for example. However, it should be noted that structure and/or configuration for achieving a point-contact are not limited to those specifically described, and that there are various other point-contact structures and ways in which a point-contact can be made.

According to one or more aspects of the present disclosure, the power transmission unit according to various embodiments herein and the image forming apparatus and/or the developing cartridge thereof employing such power transmission unit may provide one or more of the advantageous effects, which may include: 1) a reduction in the color registration error; 2) an improved quality of a color image; 3) an improved uniformity of the rotational speed of a rotating body; and 4) a transmission of rotational power that is better tolerant of some relative radial movement of the driving and driven shafts.

While the disclosure has been particularly shown and described with reference to several embodiments thereof with particular details, it will be apparent to one of ordinary skill in the art that various changes may be made to these embodiments without departing from the principles and spirit of the disclosure, the scope of which is defined in the following claims and their equivalents.

What is claimed is:

1. An image forming apparatus, comprising:

a main body;

a driving unit mounted to the main body, the driving unit comprising a driving shaft and a driving coupler connected to the driving shaft, the driving coupler having arranged thereon a plurality of driving tips; and a consumable unit detachably received in the main body, the consumable unit comprising a rotating body configured to rotate with a driven shaft and a passive coupler connected to the driven shaft, the passive coupler having arranged thereon a plurality of passive tips, corresponding ones of the plurality of driving tips and the plurality of passive tips coming into engaging contact with each other when the consumable unit is operably received in the main body, and the corresponding ones of the plurality of driving tips and the plurality of passive tips maintaining the engaging contact with each other to drive the driven shaft by driving the driving shaft when respective rotational axes of the driving shaft and the driven shaft intersect each other at a non-zero angle.

2. The image forming apparatus according to claim 1, wherein at least one of the driving coupler and the passive coupler comprises:

a primary coupler coupled to and rotatable with the at least one of the driving shaft and the driven shaft; and a secondary coupler moveable along a direction of a rotational axis of the at least one of the driving shaft and the driven shaft toward and away from the primary coupler, the secondary coupler being in one or more point-contacts with the primary coupler with respect to a rotational direction of the at least one of the driving shaft and the driven shaft.

3. The image forming apparatus according to claim 2, wherein the primary coupler comprises a plurality of circumferential projections protruding outwardly from an outer surface thereof, and wherein the secondary coupler having an inner surface defining a space into which the primary coupler is received, a plurality of accommodating grooves being arranged accommodating on the inner surface, the plurality of circumferential projections of the primary coupler each being receivable into, so as to be in a point-contact with, a respective corresponding one of the plurality of accommodating grooves.

4. An image forming apparatus, comprising:

a main body;

a driving unit mounted to the main body, the driving unit comprising a driving shaft and a driving coupler connected to the driving shaft, the driving coupler having arranged thereon a plurality of driving tips protruding in a direction parallel to a rotation axis of the driving shaft; and a consumable unit detachably received in the main body, the consumable unit comprising a rotating body configured to rotate with a driven shaft and a passive coupler connected to the driven shaft, the passive coupler having arranged thereon a plurality of passive tips, wherein corresponding ones of the plurality of driving tips and the plurality of passive tips are in a point-contact with each other with respect to a rotational direction of at least one of the driving shaft and the driven shaft.

5. The image forming apparatus according to claim 4, wherein the plurality of driving tips and the plurality of passive tips are engaged with each other when the consumable unit is operably received in the main body, and wherein the corresponding ones of the plurality of driving tips and the plurality of passive tips maintain the engaging contact with each other when respective rotational axes of the driving shaft and the driven shaft intersect each other.

6. The image forming apparatus according to claim 4, wherein at least one of the driving coupler and the passive coupler comprises:

a primary coupler coupled to and rotatable with the at least one of the driving shaft and the driven shaft; and a secondary coupler moveable along a direction of a rotational axis of the at least one of the driving shaft and the driven shaft toward and away from the primary coupler, the secondary coupler being in one or more point-contacts with the primary coupler with respect to a rotational direction of the at least one of the driving shaft and the driven shaft.

7. The image forming apparatus according to claim 6, wherein the primary coupler comprises a plurality of circumferential projections protruding outwardly from an outer surface thereof, and wherein the secondary coupler having an inner surface defining a space into which the primary coupler is received, a plurality of accommodating grooves being arranged on the inner surface, the plurality of circumferential projections of the primary coupler each being receivable into, so as to be in a point-contact with, a respective corresponding one of the plurality of accommodating grooves.

8. A developing cartridge detachably receivable in a main body of an image forming apparatus which includes a driving shaft that rotationally drives a driving coupler having arranged thereon a plurality of driving tips, comprising:

a frame defining a volume into which developer is received;

an image carrying body rotatably arranged in the frame;

a developing roller rotatably arranged adjacent the image carrying body and configured to convey the developer received in the volume to the image carrying body; and a passive coupler connected to at least one of respective rotating shafts of the image carrying body and the developing roller, the passive coupler having arranged thereon a plurality of passive tips, the plurality of passive tips arranged such that each of the plurality of passive tips comes into an engaging contact with a respective corresponding one of the plurality of driving tips of the driving coupler of the image forming apparatus when the developing cartridge is operably received in the main body of the image forming apparatus, and the corresponding ones of the plurality of driving tips and the plurality of passive tips maintaining the engaging contact with each other to drive the rotating shaft by driving the driving shaft when respective rotational axes of the driving shaft and the rotating shaft intersect each other at a non-zero angle.

9. The developing cartridge according to claim 8, wherein at least one of the driving coupler and the passive coupler comprises:

a primary coupler coupled to and rotatable with the at least one of the driving shaft and the rotating shaft; and a secondary coupler moveable along a direction of a rotational axis of the at least one of the driving shaft and the rotating shaft toward and away from the primary coupler, the secondary coupler being in one or more point-contacts with the primary coupler with respect to a rotational direction of the at least one of the driving shaft and the rotating shaft.

10. The developing cartridge according to claim 9, wherein the primary coupler comprises a plurality of circumferential projections protruding outwardly from an outer surface thereof, and wherein the secondary coupler having an inner surface defining a space into which the primary coupler is received, a plurality of accommodating grooves being arranged on the inner surface, the plurality of circumferential projections of the primary coupler each being receivable into, so as to be in a point-contact with, a respective corresponding one of the plurality of accommodating grooves.

11. A developing cartridge detachably receivable in a main body of an image forming apparatus which includes a driving shaft that rotationally drives a driving coupler having arranged thereon a plurality of driving tips protruding in a direction parallel to a rotation axis of the driving shaft, comprising:

a frame defining a volume into which developer is received;

an image carrying body rotatably arranged in the frame;

a developing roller rotatably arranged adjacent the image carrying body and configured to convey the developer received in the volume to the image carrying body; and a passive coupler which is provided in at least one rotating shaft of the image carrying body and the developing roller and comprises a plurality of passive tips, wherein corresponding ones of the plurality of driving tips and the plurality of passive tips are in a point-contact with each other with respect to a rotational direction of at least one of the driving shaft and the rotating shaft.

12. The developing cartridge according to claim 11, wherein the plurality of driving tips and the plurality of passive tips are engaged with each other when the developing cartridge is operably received in the main body of the image forming apparatus, and wherein the corresponding ones of the plurality of driving tips and the plurality of passive tips maintain the engaging contact with each other when respective rotational axes of the driving shaft and the rotating shaft intersect each other.

13. The developing cartridge according to claim 11, wherein at least one of the driving coupler and the passive coupler comprises:

a primary coupler coupled to and rotatable with the at least one of the driving shaft and the rotating shaft; and a secondary coupler moveable along a direction of a rotational axis of the at least one of the driving shaft and the rotating shaft toward and away from the primary coupler, the secondary coupler being in one or more point-contacts with the primary coupler with respect to a rotational direction of the at least one of the driving shaft and the rotating shaft.

14. The developing cartridge according to claim 13, wherein the primary coupler comprises a plurality of circumferential projections protruding outwardly from an outer surface thereof, and wherein the secondary coupler having an inner surface defining a space into which the primary coupler is received, a plurality of accommodating grooves being arranged on the inner surface, the plurality of circumferential projections of the primary coupler each being receivable into, so as to be in a point-contact with, a respective corresponding one of the plurality of accommodating grooves.

* * * * *